US005897022A

United States Patent [19]

Mann

[11] Patent Number: 5,897,022

[45] Date of Patent: Apr. 27, 1999

[54] KINETIC ACTIVITY GUMBALL DISPENSING DEVICE

[76] Inventor: Ross Mann, 474 E. 1310 South, Kaysville, Utah 84037

[21] Appl. No.: 08/891,258

[22] Filed: Jul. 10, 1997

Related U.S. Application Data

[60] Provisional application No. 60/021,719, Jul. 12, 1996.

[51] Int. Cl.[6] ..... A24F 15/04

[52] U.S. Cl. ..... 221/24; 221/155

[58] Field of Search ..... 221/24, 155, 284, 221/282, 196, 194, 265

[56] References Cited

U.S. PATENT DOCUMENTS

| | | | |
|---|---|---|---|
| 1,725,965 | 8/1929 | Ormiston | 221/24 |
| 1,843,587 | 2/1932 | Wolin et al. | 273/138 |
| 1,859,635 | 5/1932 | Rose | 221/24 |
| 2,429,510 | 10/1947 | Callison | 221/155 |
| 3,077,254 | 2/1963 | Goldfarb | 221/155 |
| 3,081,908 | 3/1963 | Sieqfried | 221/155 |
| 4,976,376 | 12/1990 | Williams | 221/24 |
| 5,452,822 | 9/1995 | Haymond | 221/24 |

FOREIGN PATENT DOCUMENTS

| | | | |
|---|---|---|---|
| 4-367680 | 12/1992 | Japan | 273/121 B |

*Primary Examiner*—Kenneth Noland

*Attorney, Agent, or Firm*—Schweitzer Cornman Gross & Bondell LLP

[57] ABSTRACT

A kinetic activity gumball-dispensing device has a hopper containing a plurality of gumballs and has at least one alternate-material ball, where the alternate-material ball travels along a first visible route which begins and ends in an opaque enclosure and which is defined by a series of visually interesting kinetic activities. The gumballs are dispensed along a second visible route after the return of the alternate-material ball from the first route, which second route begins adjacent the opaque enclosure. The gumball-dispensing device thus gives the appearance that the gumball dispensed is the ball which traveled the first visible route. The series of kinetic activities includes an inclined, pendular staircase with a series of pivoting, pendular steps; a turntable; an elevator having a pivoting carrier; a swivelling bucket mechanism; and a trampoline means aligned to intercept the alternate-material ball falling from the bucket. Computer controlling means receive signals from sensors connected to the kinetic activity mechanisms to control timing and operation.

30 Claims, 6 Drawing Sheets

18
20
19
34
35
178
196
3
3
158
38
44
16
106
14
120
10
160
28
82
17
86
88
26
84
198
96
32
24
11
15
22
12

FIG. 6
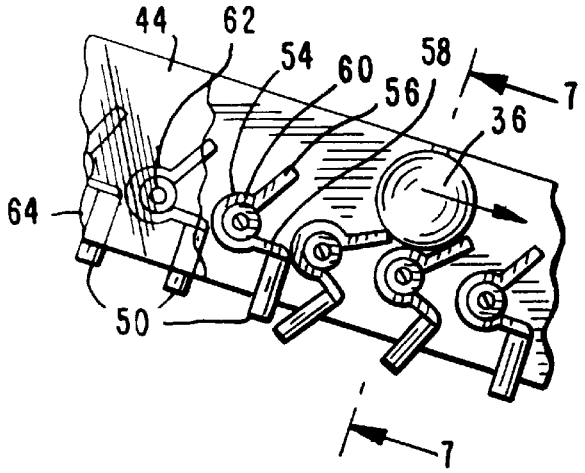
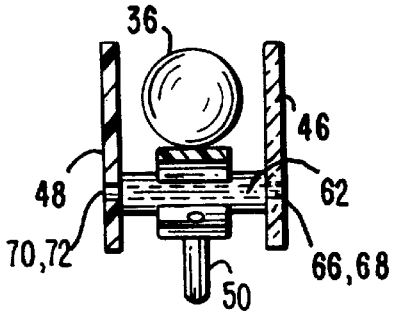
FIG. 7
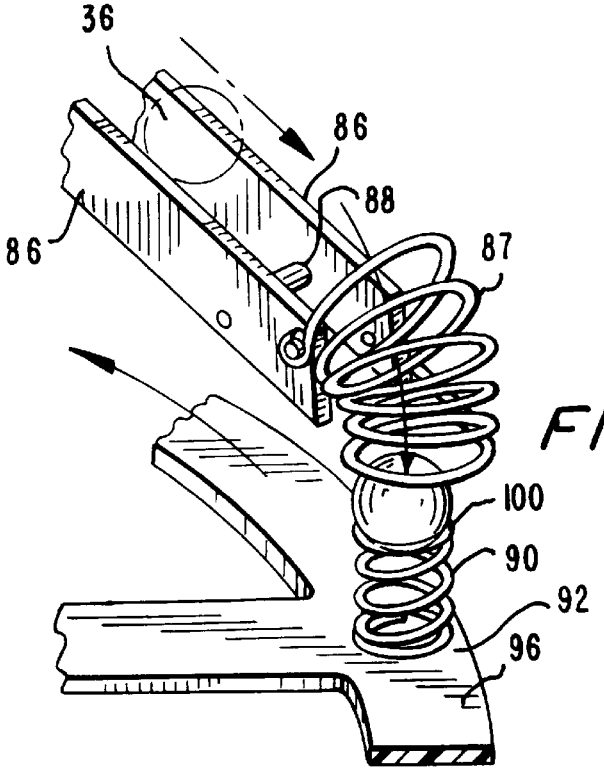
FIG. 8

KINETIC ACTIVITY GUMBALL DISPENSING DEVICE

RELATED APPLICATIONS

This application claims the benefit of U.S. Provisional Application No. 60/021,719, filed Jul. 12, 1996.

BACKGROUND OF THE INVENTION

1. Field of the Invention

The present invention relates to methods and devices for dispensing gumballs. More particularly, the present invention relates to methods and mechanisms for use in devices that incorporate the dispensing of a gumball with a series of entertaining kinetic activities.

2. The Prior Art

Devices for dispensing gumballs have long been available. Coin-operated devices to dispense one of a number of colored, spherical gumballs collected in a transparent hopper are located in stores and businesses around the country. In addition, similar devices dispense other types of candy or small toys. More particularly, there have also been coin-operated devices designed to dispense candy or toys in conjunction with a series of entertaining kinetic activities, in the spirit of Rube Goldberg. A kinetic activity involves the substantially controlled motion of a candy or toy to be dispensed via creative mechanisms and routes.

Devices employing a series of entertaining kinetic activities and used to specifically dispense gumballs (hereinafter kinetic-activity gumball dispensers) have been available for public use for at least four years. Prior art kinetic-activity gumball dispensers have all attempted to provide an entertaining series of kinetic activities, wherein a gumball is guided from mechanism to mechanism along a substantially controlled route and eventually dispensed to a customer.

However, prior art kinetic-activity gumball dispensers have been subject to a number of difficulties. One critical key to a gumball s successful navigation of a particular kinetic-activity route has been the degree of sphericity that the gumball possesses, i.e., its roundness. The motion of a truly spherical gumball is fairly predictable, and its motion can be accounted for in the design and operation of a kinetic-activity gumball dispenser. However, the majority of conventional gumballs, as supplied by manufacturers and distributors, are not perfectly spherical, instead having indentations and other defects. In fact, some gumballs are so severely deformed as to be unrecognizable as spheres, but are instead tooth-shaped. Such deformations cause conventional kinetic-activity gumball dispensers to perform improperly, lock up, or even damage internal mechanisms.

Suppliers of conventional kinetic-activity gumball dispensers have attempted to solve this problem by instructing personnel who fill the gumball hopper of a kinetic-activity gumball dispenser to sort out gumballs that appear to be defective. However, such personnel rarely do so. It is difficult to detect all of the defective gumballs in a given batch, both because of the sheer number of gumballs to be inspected and the difficulty in predicting how serious a defect must be before it should be removed. Moreover, a kinetic-activity gumball dispenser is much less attractive to a store or business when gumballs must be inspected, instead of simply poured in the hopper.

Another approach has been to install a mechanism that automatically checks the sphericity of each gumball as it presents itself for dispensing and that discards any gumballs that fail to meet specific sphericity requirements. However, this makes the device substantially more complex and more expensive because measuring sphericity is difficult. Moreover, this approach requires the designer to know exactly how spherical a gumball must be to successfully navigate the particular kinetic-activity route. It is difficult to translate functional requirements for a gumball into quantitative geometric requirements.

Thus, it can be seen that what is needed in the art are methods and mechanisms that overcome the long-felt difficulties presented to kinetic-activity gumball dispensers by the inherent defects in gumball sphericity.

Another pressing need in the art is for new, reliable, and creative mechanisms for use along the substantially controlled route of a kinetic-activity gumball dispenser. A great deal of the appeal of a kinetic-activity gumball dispenser lies in its uniqueness and in the curiosity it evokes in onlookers as it operates. In turn, it is the presence of new and creative mechanisms along the substantially controlled route of a kinetic-activity gumball dispenser that gives the dispenser its uniqueness. Thus, after a given mechanism has been included in kinetic-activity gumball dispensers for several years, the curiosity it evokes in onlookers can be significantly diminished, and a new, more creative mechanism must be substituted in its place.

Moreover, new mechanisms are also difficult to come by since they must be reliable. In order to place a given mechanism along the substantially controlled route of a kinetic gumball dispenser, the mechanism must be able to account for the variability in motion of any given gumball. As discussed above, to account for such variability in the design and operation of a mechanism is difficult, given the variability in sphericity and other qualities of gumballs.

Thus, it can be seen that what is needed in the art are new, creative, and reliable devices for use along the substantially controlled route of kinetic-activity gumball dispensers.

BRIEF SUMMARY AND OBJECTS OF THE INVENTION

The present invention relates to methods and mechanisms for use with kinetic-activity gumball dispensers. It is an object of the present invention to provide methods and mechanisms that overcome the long-felt difficulties presented to kinetic-activity gumball dispensers by the inherent defects in gumball sphericity. It is a further object of the present invention to provide new, creative, and reliable devices for use along the substantially controlled route in kinetic-activity gumball dispensers.

The present invention overcomes the long-felt difficulties presented by the inherent defects in gumball sphericity by employing and recycling a ball that is approximately the same size, shape, and color as a normal gumball, but that is made of acrylic plastic or other suitable material (e.g., other plastics, metal, wood, etc). Such an alternate-material ball is substituted for the standard gumballs now used in conventional kinetic-activity gumball dispensers to provide significantly improved control, reliability, and performance. Thus, in any given kinetic-activity gumball dispenser, a particular kinetic-activity route is navigated by an alternate-material ball, instead of a standard gumball, and then re-used to navigate the route again. After the alternate-material ball has navigated the kinetic-activity route, a standard gumball is dispensed to the customer. An alternate-material ball is capable of being manufactured to meet relatively strict sphericity requirements, suitable for very reliable operation in any type of kinetic-activity gumball dispenser. In addition, a mechanism is presented that allows for the dispensing and recycling of such an alternate-material ball.

In addition, the present invention provides several new, creative, and reliable mechanisms for use within kinetic-activity gumball dispensers. These include a pendular staircase, an inclined double-rail track, a spinning whirly, a tilt-releasing elevator, a coaster track, a crank arm and swiveling bucket, and a trampoline.

For a more complete understanding of the above and other features and advantages of the invention, reference should be made to the following detailed description of a preferred embodiment of the invention and to the accompanying drawings.

BRIEF DESCRIPTION OF THE FIGURES

FIG. 6 is a sectional, front elevational view of the first pendular staircase of the present invention;

FIG. 7 is a cross sectional view taken along line 7—7 of FIG. 6; and FIG. 8 is a sectional perspective view of the funneling and holding means associated with the turntable and rail.

DETAILED DESCRIPTION OF THE PREFERRED EMBODIMENT

The preferred embodiment of the invention is depicted in FIGS. 1–8. The present invention may be embodied in other specific forms without departing from its spirit or essential characteristics. Thus, the illustrated embodiment is to be considered in all respects only as illustrative and not restrictive.

Figure 1:
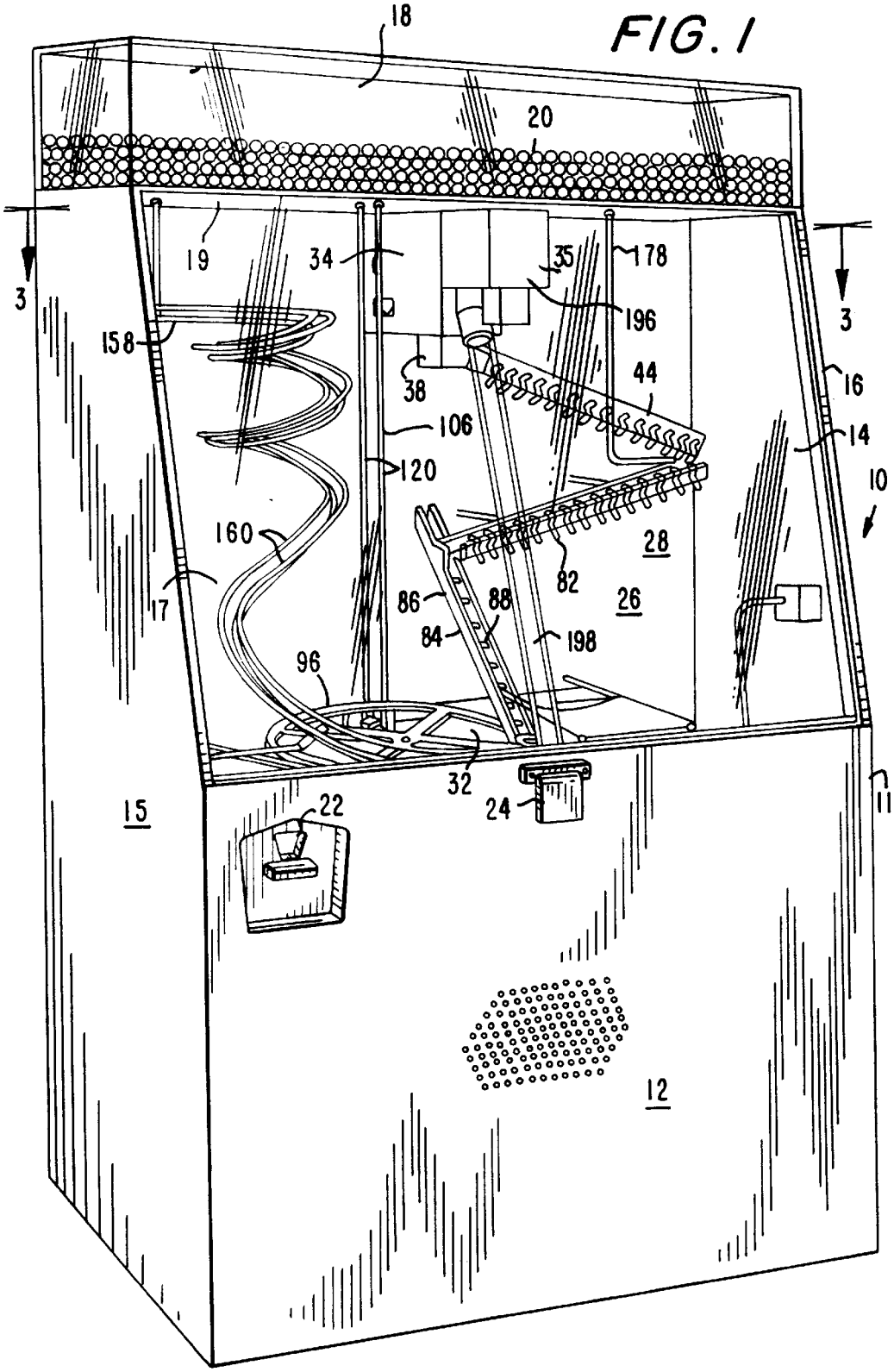
FIG. 1 is a perspective view of the front of a coin-operated kinetic-activity gumball dispenser of the present invention.

As shown in FIG. 1, a kinetic-activity gumball dispenser 10 comprises a housing 11, which has a front vertical panel 12, a front angled transparent panel 14, a left side panel 15, a right side panel 16, a back panel 17, and a top panel 19. Located above housing 11 and in contact with top panel 19 is a transparent hopper 18, containing hundreds of standard gumballs 20. Mounted within front vertical panel 12 is a coin-receiving mechanism 22 and a gumball dispenser door 24. Housing 11 encompasses an inner cavity 26, divided into an upper inner cavity 28 and a lower inner cavity (not shown) by an inclined middle panel 32. Front angled transparent panel 14 allows an observer to look into upper inner cavity 28, but inclined middle panel 32 prevents an observer from looking through front angled transparent panel 14 into the lower inner cavity (not shown). Inclined middle panel 32 inclines down towards back panel 17 at approximately an 8-degree angle. Located below inclined middle panel 32 in the lower inner cavity (not shown) is a computer controller (not shown). Front vertical panel 12 is hinged (or alternatively, removable) to allow access to the lower inner cavity (not shown) and the computer controller (not shown). The computer controller (not shown) receives signals indicating the position of various mechanisms in kinetic-activity gumball dispenser 10 and sends signals to control the motion of said mechanisms, which mechanisms will be described in detail below.

Mounted beneath top panel 19 is a modified conventional gumball hopper 34. Inside modified conventional gumball hopper 34 is at least one alternate-material ball 36 (hidden), preferably comprised of a one inch in diameter acrylic plastic ball. One skilled in the art would recognize that other suitable material could be used (e.g. other plastics, wood, metal, etc). Any material that allows for manufacturing a ball with relatively strict sphericity requirements and which provides predictable and controllable motion is acceptable.

Figure 2:
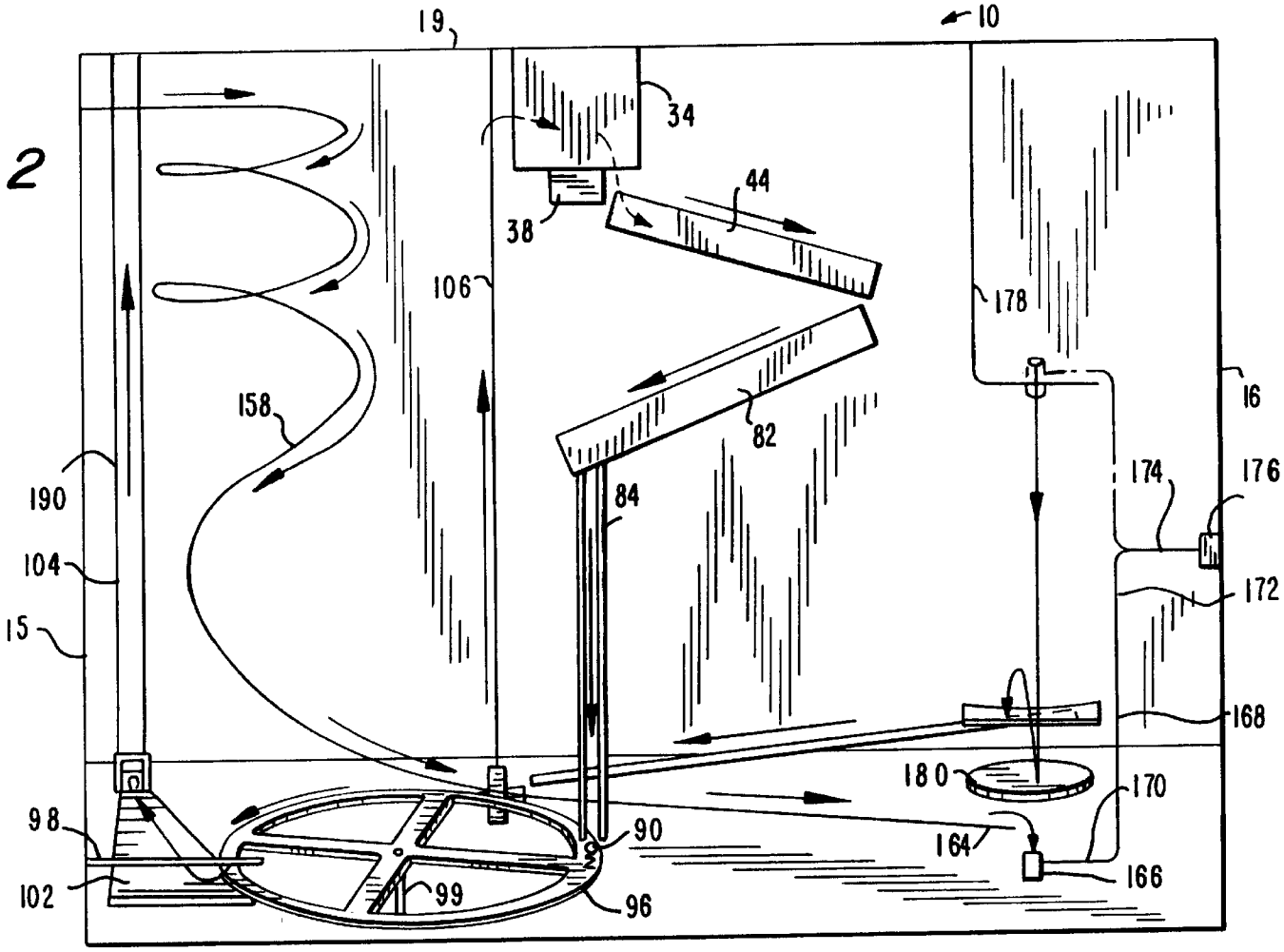
FIG. 2 is a schematic view of the path of the alternate-material ball within the kinetic-activity gumball dispenser shown in FIG. 1.

Referring to FIGS. 1 and 2, the modified conventional gumball hopper 34 forms an opaque enclosure below top panel 19 from which alternate-material ball 36 is released. The standard gumballs 20 are preferably released through a second opaque enclosure 35 directly in front of the modified conventional gumball hopper 34.

When a customer inserts a coin in coin receiving mechanism 22, an electric signal is received by the computer controller (not shown). The computer controller (not shown) switches on an electric motor 38 preferably mounted beneath modified conventional gumball hopper 34. Electric motor 38 turns a conventional dispenser (not shown), located inside modified conventional gumball hopper 34, thereby allowing alternate-material ball 36 to drop out of modified conventional gumball hopper 34. As alternate-material ball 36 drops out of modified conventional gumball hopper 34, it passes through an aperture (not shown) of an optical sensor (not shown), which results in a signal to the computer controller (not shown). In response, the computer controller turns off electric motor 38. Of course, other types of sensors known to those skilled in the art may be substituted for the optical sensor (not shown). Alternate-material ball 36 drops from modified conventional gumball hopper 34 through the aperture (not shown) of the optical sensor (not shown) and onto a first of several sequential kinetic activities, each of which is described briefly here and in detail below. The first of the kinetic activities is preferably a first pendular staircase 44 comprising a series of pendular steps down which alternate-material ball 36 rolls. After alternate-material ball 36 travels down the first pendular staircase 44, it drops onto second pendular staircase 82 which is preferably substantially identical to first pendular staircase 44. Alternate-material ball 36 travels down second pendular staircase 82 and drops onto double rail track 84, which directs alternate-material ball 36 toward turntable 96. A funnelling means (not shown) at the end of double rail track 84 directs alternate-material ball 36 onto a holding means 90 of turntable 96 which is positioned therebelow. Turntable 96 then rotates counterclockwise until alternate-material ball 36 contacts dump-rod 98, at which point alternate-material ball 36 is ejected from turntable 96 unto ramp 102. Ramp 102 directs alternate-material ball 36 toward tilt-releasing left elevator 104 which elevates alternate-material ball 36 to the top of coaster track 158.

Alternate-material ball 36 then travels down coaster track 158 to swiveling bucket 166 which rotates and lifts alternate-material ball 36. During rotation of swiveling bucket 166 bucket dump-rod 178 ejects alternate-material ball 36 causing alternate-material ball 36 to free fall onto trampoline 180. Alternate-material ball 36 is then directed downward toward a second tilt-releasing return elevator 106 which returns alternate-material ball 36 to modified conventional gumball hopper 34. When alternate-material ball 36 returns to the opaque portion of modified conventional gumball hopper 34, a standard edible gumball 20 is dispensed from transparent hopper 18 through transparent gumball dispensing tube 198 (shown in FIGS. 1 and 4). Therefore, it can be appreciated that, to the observer, it can appear that the standard gumball 20 dispensed through transparent gumball dispensing tube 198 is the object which travelled the visually-interesting kinetic route.

Referring to FIGS. 6 and 7, first pendular staircase 44 comprises a back sidewall 46, a transparent front sidewall 48, and fifteen pendular steps 50, each preferably substantially identical to the others. Back sidewall 46 and front sidewall 48 are substantially the same size and shape and are oriented substantially parallel to each other and to back panel 17 and front vertical panel 12. Back sidewall 46 and front sidewall 48 are also inclined so as to facilitate the rolling of alternate-material ball 36 down pendular steps 50 and are configured as two sides of a channel to guide alternate-material ball 36 down pendular steps 50 as alternate-material ball 36 rolls.

Each of pendular steps 50 preferably comprises a conventional plastic electrical cable clip 54, having an upper ear 56, a lower ear 58, and a cylindrical aperture 60; an axle 62 journaled within cylindrical aperture 60; and a counterweight 64. Axle 62 is substantially cylindrical in shape and is preferably oriented such that its longitudinal axis extends horizontally and perpendicular to back sidewall 46 and front sidewall 48. A back end 66 of axle 62 is journaled within a hole 68 in back sidewall 46. Axle 62 extends forward through cylindrical aperture 60, and a front end 70 of axle 62 is journaled within a hole 72 in front sidewall 48. Counterweight 64 can also be substantially cylindrical in shape and is also preferably oriented such that its longitudinal axis extends substantially vertically underneath lower ear 58. Counterweight 64 can be secured to lower ear 58 by means of a bolt that extends through a hole bored in lower ear 58, continues longitudinally through counterweight 64, and is threaded into an acorn nut. Thus, when alternate-material ball 36 rolls onto upper ear 54 of one of the pendular step 50, the pendular step 50 rotates clockwise about axle 62 such that the upper ear 56 tilts downwardly forming a rolling surface toward the next pendular step.

The process repeats itself for each of pendular steps 50 until alternate-material ball 36 rolls off the last pendular step and onto the next mechanism, in this embodiment a second pendular staircase 82. Second pendular staircase 82 is substantially the same as first pendular staircase 44, varying only in the number of pendular steps and the direction of incline. Second pendular staircase 82 comprises seventeen pendular steps, rather than fifteen, and slopes down from right to left, instead of from left to right.

Referring to FIGS. 1 and 8, after alternate-material ball 36 drops off second pendular staircase 82, it rolls onto and down inclined double-rail track 84. Double-rail track 84 comprises two rails 86,86 and a plurality of spacers 88. Spacers 88 are located between and perpendicular to rails 86,86. Spacers 88 function to keep rails 86,86 a critical distance apart: far enough apart to keep a large enough portion of alternate-material ball 36 between rails 86,86 in order to ensure that the downward rolling motion of alternate-material ball 36 is stable and unlikely to lose contact with rails 86,86, yet close enough together that alternate-material ball 36 does not fall between rails 86,86. Alternate-material ball 36 then drops off double-rail track 84 into a funneling means 87, which directs alternate-material ball 36 to a holding means 90 of turntable 96. Funneling means 87 can comprise a wire coil with one end aligned to capture alternate-material ball 36 rolling off of double-rail track 84 and another end bent downward and aligned with holding means 90.

Referring to FIGS. 2–4 and 8, holding means 90 is rigidly secured to a platform 92, which can be one of eight circular platforms, each equally spaced around and rigidly fixed to the circumference of a four-spoke turntable 96 which is mounted on a vertically-oriented shaft 99 of an electric motor (not shown). A set amount of time after alternate-material ball 36 has passed through the aperture (not shown) of the optical sensor (not shown) (enough time to allow alternate-material ball 36 to roll down first pendular staircase 44, second pendular staircase 82, double-rail track 84, and into holding means 90), the computer controller (not shown) switches on the electric motor (not shown), thereby rotating turntable 96 counterclockwise as viewed from above. Alternate-material ball 36 continues to remain in holding means 90 as turntable 96 rotates approximately 260 degrees, at which point alternate-material ball 36 is knocked off holding means 90 by a dump rod 98 protruding from left side panel 15. Dump rod 98 is preferably mounted at such a height as to correspond to the height of alternate-material ball 36 as alternate-material ball 36 sits in holding means 90. Holding means 90 holds alternate-material ball 36 snugly enough to keep alternate-material ball 36 from falling off holding means 90 as turntable 96 is propelled, but not so snugly as to prevent dump rod 98 from knocking alternate-material ball 36 off holding means 90 when dump rod 98 comes in contact with alternate-material ball 36. In the embodiment depicted in FIG. 8 this is accomplished by the unique construction of holding means 90. Holding means 90 is preferably constructed of aluminum rod, wrapped with heat-shrink plastic tubing, and formed into a coil 100 approximately seven-eighths of an inch in diameter, such that when alternate-material ball 36 rests on top of coil 100, the surface of alternate-material ball 36 extends approximately one-quarter of an inch below the top of coil 100.

Figure 3:
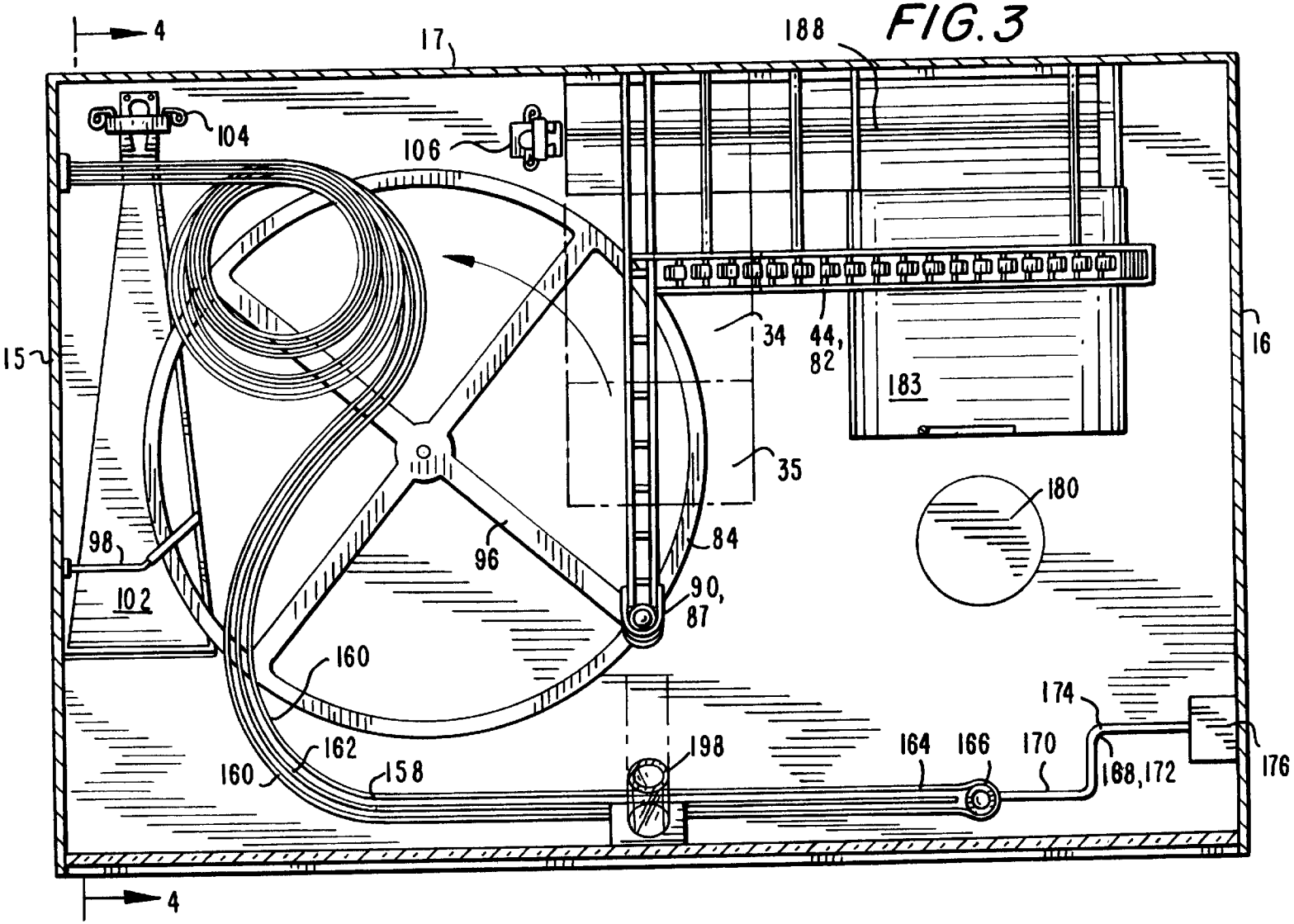
FIG. 3 is a top plan view taken along line 3—3 of FIG. 1.

As best seen in FIGS. 2–3, after alternate-material ball 36 has been knocked off holding means 90 by dump rod 98, alternate-material ball 36 falls onto ramp 102. Turntable 96 continues to rotate until it has rotated 360 degrees back to its original position. Meanwhile, alternate-material ball 36 has been rolling down ramp 102. Ramp 102 inclines down towards back panel 17, and tapers to become more narrow as it inclines down.

Figure 5:
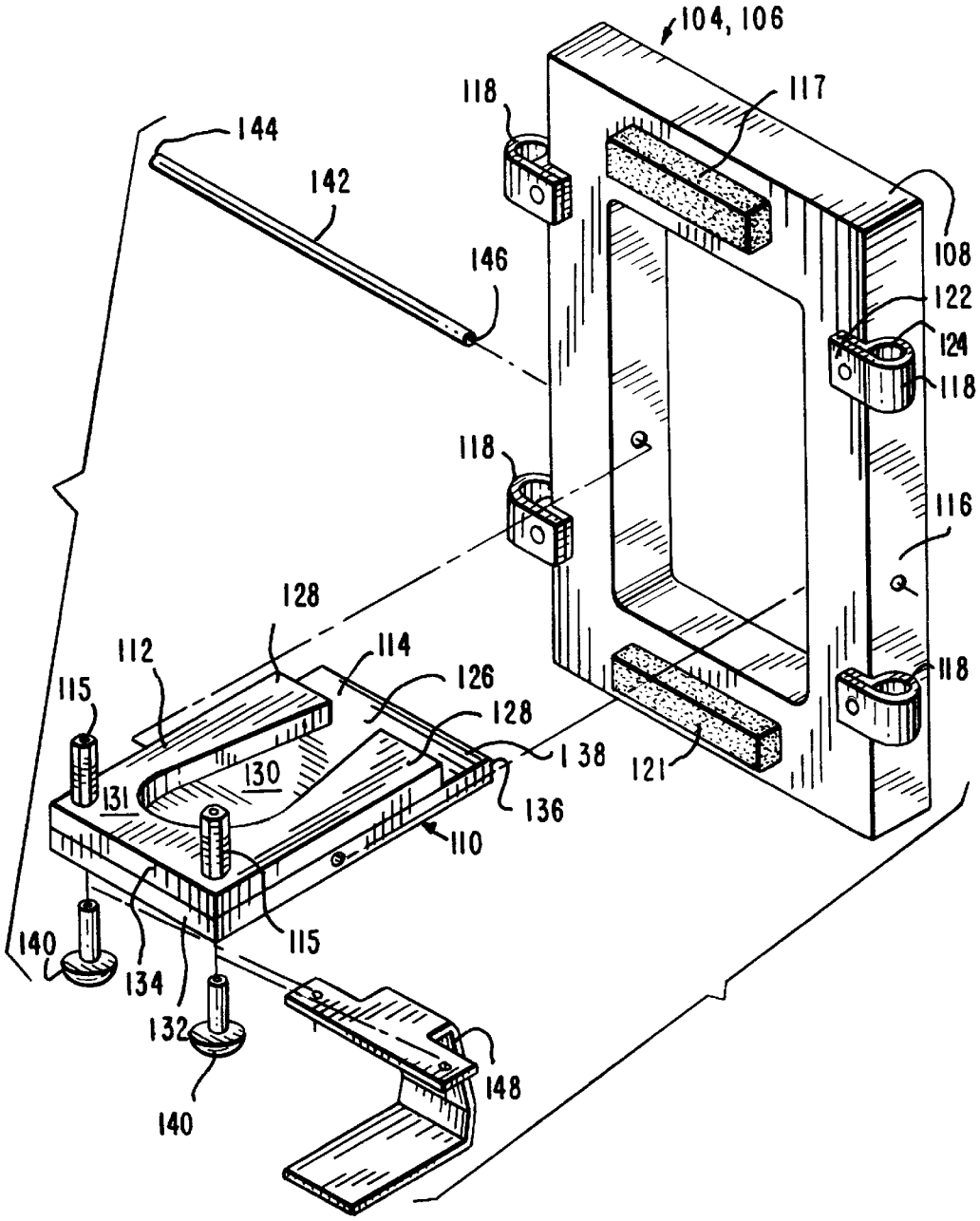
FIG. 5 is an exploded view of the tilt-releasing lift elevator of the present invention.

The shape and orientation of ramp 102 directs alternate-material ball 36 to roll down ramp 102 and into a tilt-releasing lift elevator 104. Tilt-releasing lift elevator 104, parts of which are shown in FIG. 5, can be substantially the same as tilt-releasing return elevator 106, see FIG. 2. Accordingly, numbers labelling features that are shown for tilt-releasing return elevator 106 apply equally to corresponding features of tilt-releasing lift elevator 104 that are not shown. Tilt-releasing return elevator 106 preferably comprises an elevator yoke 108 and an elevator carrier 110, detailed in FIG. 5. Elevator carrier 110 comprises an elevator roost 112, a support plate 114, and two hex standoffs 115.

Elevator yoke 108 comprises a frame 116 and sliding attachment means 118. Sliding attachment means 118 are rigidly mounted to frame 116 so as to restrict frame 116 to vertical linear movement parallel to rods 120 (see FIGS. 1 and 2). For tilt-releasing lift elevator 104, sliding attachment means 118 restrict frame 116 to vertical linear movement parallel to rods 120. In the preferred embodiment, sliding attachment means 118 is comprised of four electrical cable clips, each having two ears 122, and a cylindrical aperture 124 through which one of rods 120 extends. Ears 122 are clamped together and fastened to frame 116 so as to trap one of rods 120 within cylindrical aperture 124 and so as to rigidly fasten clips 119 to frame 116.

Elevator roost 112 is preferably shaped like a horseshoe, wherein the width of a channel 126 formed between two free ends 128,128 of elevator roost 112 is less than the diameter of alternate-material ball 36. Channel 126 gradually widens into a circular enlargement 130. The gradually widening structure of channel 126 serves to make alternate-material ball 36 roll toward circular enlargement 130 even when elevator roost 112 is horizontally level. If placed in channel 126 near free ends 128, alternate-material ball 36 will roll toward circular enlargement 130 because there is a gravitational gradient in that direction. As alternate-material ball 36 rolls toward circular enlargement 130, the corresponding width of channel 126 becomes greater, causing more of alternate-material ball 36 to drop below the top surface 131 of elevator roost 112 and thus the center of mass of alternate-material ball 36 to drop. Support plate 114 is rigidly attached underneath elevator roost 112, such that a first side face 132 of support plate 114 is flush with a first side face 134 of elevator roost 112, but a second side face 136 of support plate 114 extends past two free ends 128 to form a lip 138. The diameter of circular enlargement 130 is great enough that when alternate-material ball 36 is in circular enlargement 130, the surface of alternate-material ball 36 is in contact with support plate 114. By rolling from channel 126 to circular enlargement 130, the center of mass of alternate material ball 36 drops by a height nearly equal to the thickness of elevator roost 112. Thus a gravitational gradient exists in that direction.

Each of the two hex standoffs 115 is substantially cylindrical and oriented such that its longitudinal axis is substantially perpendicular to top surface 131 of elevator roost 112. Each hex standoff 115 can be rigidly secured to elevator carrier 110 by means of a screw 140 that extends vertically upwards through support plate 114, elevator roost 112, and is threaded longitudinally into hex standoff 115. The function of hex standoffs 115 is to hold alternate-material ball 36 in circular enlargement 130 when elevator carrier 110 is rotated. One of ordinary skill in the art would recognize that hex standoffs 115 could, alternatively, be attached to elevator carrier 110 in a number of equivalent ways (e.g., adhesives, bolt and nut configuration, manufacturing elevator carrier 110 as one part, etc). One of ordinary skill in the art would also recognize that any type of fence or restricting means could be used to accomplish the same function as hex standoffs 115.

Elevator carrier 110 is pivotally connected to elevator yoke 108 by means of an axle 142 such that elevator carrier 110 is journaled about axle 142. A first end 144 of axle 142 is rigidly fixed to frame 116 of elevator yoke 108. Axle 142 extends from first end 144 through elevator carrier 110 to a second end 146. Second end 146 of axle 142 is also rigidly fixed to frame 116, opposite first end 144. One of ordinary skill in the art would recognize that, alternatively, axle 142 could be rigidly attached to elevator carrier 110 instead of frame 116 and thus rotate relative to frame 116.

Axle 142 is positioned off-center with respect to the center of mass of elevator carrier 110, so that, by default, a rotational moment exists. That is, the axle 142 is located between the center of mass and the lip 138. Thus, the default position of elevator carrier 110 is to be rotated about axle 142 such that lip 138 is higher than hex standoffs 115 and a stopper 148 mounted underneath support plate 114 makes contact with elevator yoke 108.

Thus, the shape and orientation of ramp 102 directs alternate-material ball 36 to roll down ramp 102 and into tilt-releasing lift elevator 104. Alternate-material ball 36 first rolls onto channel 126 of tilt-releasing lift elevator 104 and then towards circular enlargement 130 of tilt-releasing lift elevator 104. Alternate-material ball 36 stops when it makes contact with hex standoffs 115.

The computer controller (not shown) receives a signal when four-spoke whirly 96 has rotated 360 degrees back to its original position. In response, computer controller (not shown) switches on a lift elevator motor (not shown) that pulls a nylon string (not shown) attached to elevator yoke 108 of tilt-releasing lift elevator 104. This causes tilt-releasing lift elevator 104 to ascend along rods 120. Alternate-material ball 36 ascends in elevator carrier 110 of tilt-releasing lift elevator 104, until lift elevator dump rod (not shown) catches lip 138 of tilt-releasing lift elevator 104 and causes lip 138 to rotate down, thereby causing alternate-material ball 136 to roll from circular enlargement 130 to channel 126 and to drop off elevator carrier 110. The lift elevator motor (not shown) continues to raise tilt-releasing lift elevator 104 until a top magnet 117 mounted on frame 116 moves close enough to an upper limit switch sensor (not shown) that a signal is sent to the computer controller (not shown). In response, the computer controller (not shown) reverses the lift elevator motor (not shown), causing tilt-releasing lift elevator 104 to be lowered until a bottom magnet 121 mounted on frame 116 moves close enough to a lower limit switch sensor (not shown) that a signal is sent to the computer controller (not shown). In response, the computer controller (not shown) stops the lift elevator motor (not shown), causing tilt-releasing lift elevator 104 to remain at rest and in position to receive another alternate-material ball from ramp 102. The limit switch sensors are preferably mounted on metal rods (not shown), wrapped with heat-shrink tubing. The plasticity of the metal rods allows the location of the limit switch sensors to be adjusted in order to ensure reliable operation.

Referring to FIGS. 1–4, when the lift elevator dump rod (not shown) catches lip 138, alternate-material ball 36 rolls off elevator carrier 110 onto coaster track 158. Coaster track 158 preferably comprises two pieces of flexible plastic tubing 160 and a piece of aluminum rod 162, coated with heat shrink tubing. Aluminum rod 162 acts as the backbone of coaster track 158. Aluminum rod 162 bends in a downwardly spiraling helix and is then mounted along left side panel 15 and then along front vertical panel 12. Flexible plastic tubing 160 parallels aluminum rod 162 and is offset horizontally in back and front of and vertically upward from aluminum rod 162 in order to ensure that alternate-material ball 36 remains within coaster track 158. Thus, flexible plastic tubing 160 acts as a side railing for alternate-material ball 36 as alternate-material ball 36 rolls down coaster track 158.

Figure 4:
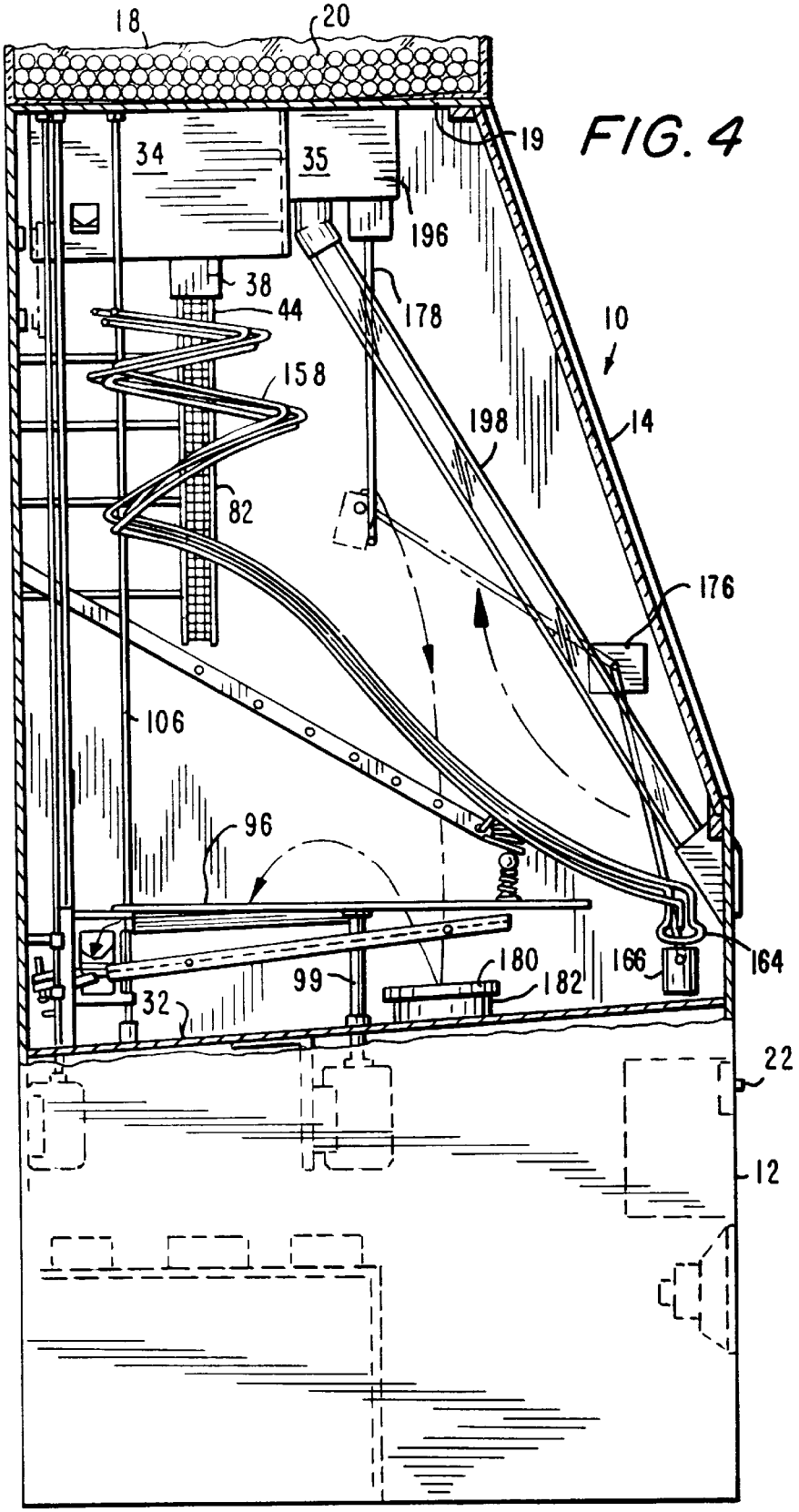
FIG. 4 is a side elevational view taken along line 4—4 of FIG. 3.

Referring to FIGS. 2–4, at a bottom end 164 of coaster track 158, alternate-material ball 36 drops into a swiveling bucket 166. Swiveling bucket 166 is mounted to swivel about a first horizontal portion 170 of a crank arm 168. Crank arm 168 is substantially Z-shaped, comprising first horizontal portion 170, a main shaft 172, and a second horizontal portion 174. Second horizontal portion 174 is rigidly connected to the shaft of a crank-propelling motor 176, mounted on right side panel 16. Crank-propelling motor 176 begins rotating crank arm 168 when sent a signal by the computer controller (not shown). Swiveling bucket 166 moves upward as crank arm 168 rotates, always maintaining its original orientation, much like a seat on a ferris wheel. Thus alternate-material ball 36 remains in swiveling bucket 166 through approximately 200 degrees of rotation until swiveling bucket 166 comes in contact with a bucket dump rod 178. Bucket dump rod 178 forces swiveling bucket 166 to tip, causing alternate-material ball 36 to drop onto trampoline 180.

Trampoline 180 is preferably circular and constructed of lycra which can be mounted over a PVC six-inch- inner-diameter pipe 182 and secured by a six-and-one-half-inch-diameter hose clamp (not shown). Pipe 182 is preferably rigidly fixed to a flat platform (not shown) made of ABS plastic. A carriage bolt (not shown) can extend through the flat platform (not shown) and through a slot (not shown) cut in middle panel 32, to be received by a large washer (not shown) and a wingnut (not shown). This configuration allows the location of circular trampoline 180 to be easily adjusted to fine tune the bounce path of alternate-material ball 36. Since middle panel 32 is oriented at a downwardly sloping angle from front to back, trampoline 180 is also angled rearwardly. This provides that alternate-material ball 36 will bounce toward back panel 17.

To control the falling alternate-material ball 36, a net 183 can be suspended above inclined middle panel 32 to absorb the kinetic energy of the falling alternate-material ball 36. Alternatively, an energy-absorbing cushion (not shown) such as a PVC-based plastic pad, can be placed on top of middle panel 32 and aligned to catch alternate-material ball 36. Alternate-material ball 36 automatically rolls down towards back panel 17 and trough 188 because inclined middle panel 32 is inclined down towards back panel 17 and trough 188 at approximately an 8-degree angle. Thus, if for some reason, and at any time, alternate-material ball 36 falls, inclined middle panel 32 will cause alternate-material ball 36 to roll to trough 188. Once in trough 188, alternate-material ball 36 rolls towards tilt-releasing return elevator 106. Alternate-material ball rolls into elevator carrier 110 of tilt-releasing return elevator 106 substantially as alternate-material ball 36 previously rolled into elevator carrier 110 of tilt-releasing lift elevator 104. As with tilt-releasing lift elevator 104, tilt-releasing return elevator 106 is also controlled by the computer controller (not shown), top and bottom magnets and corresponding limit switch sensors. Tilt-releasing return elevator 106 runs along rods 120 and returns alternate-material ball 36 up to modified conventional gumball hopper 34. As with tilt-releasing lift elevator 104, tilt-releasing lift elevator 106 releases alternate-material ball 36 when a dump rod (not shown) comes into contact with lip 138 of tilt-releasing return elevator 106. Alternate-material ball 36 rolls off tilt-releasing return elevator 106, through a door (not shown) in modified conventional gumball hopper 34. If, as depicted, a conventional gumball hopper is used, the door (not shown) must be cut in modified conventional gumball hopper 34 to allow for recycling of alternate-material ball 36.

After alternate-material ball 36 has rolled through the door (not shown) and into modified conventional gumball hopper 34, the computer controller (not shown) switches on a gumball-dispensing electric motor 196. Gumball-dispensing electric motor 196 dispenses one of standard gumballs 20 from transparent hopper 18, and through transparent gumball dispensing tube 198, to gumball dispenser door 24, where it can be retrieved by a customer.

It should be understood, of course, that the specific form of the invention herein illustrated and described is intended to be representative only, as certain changes may be made therein without departing from the clear teachings of the disclosure. Specifically, the sequence and presence of the specific kinetic activities described herein can be altered without departing from the scope and spirit of the invention. Accordingly, reference should be made to the following appended claims in determining the full scope of the invention.

What is claimed is:

1. A kinetic activity gumball-dispensing device, comprising:

(a) a hopper containing a plurality of gumballs;

(b) at least one alternate-material ball;

(c) a first route for said alternate-material ball, said alternate material ball being visible at least along a portion of said first route;

(d) a second route for said gumballs;

(e) means to release said alternate-material ball along said first route, and means to receive said alternate-material ball from said first route; and (f) means to dispense one of said gumballs along said second route;

(g) whereby said alternate-material ball can travel said first route predictably and repeatedly to provide a reliable means for the gumball dispensing-device to perform visually-interesting kinetic activities.

2. A kinetic activity gumball-dispensing device as in claim 1, wherein said first route comprises a series of kinetic mechanisms defining a substantially controlled route for said alternate-material ball.

3. A kinetic activity gumball-dispensing device as in claim 2, wherein said alternate-material ball has a predetermined sphericity.

4. A kinetic activity gumball-dispensing device as in claim 1, wherein said dispensing means is actuated after the return of said alternate-material ball from said first route.

5. A kinetic activity gumball-dispensing device as in claim 1, wherein:

(a) said gumball-dispensing device further comprises opaque enclosure means;

(b) said first route begins and ends inside said opaque enclosure means;

(c) said second route begin s inside said opaque enclosure means; and (d) said means to dispense one of said gumballs along said second route is actuated after said alternate-material ball enters said opaque enclosure means;

(e) whereby said alternate-material ball received into said opaque enclosure means and said one gumball subsequently dispensed from said opaque enclosure means can appear to be one and the same.

6. A kinetic activity gumball-dispensing device as in claim 5, wherein:

(a) said opaque enclosure means further comprises separate housings, a first housing for said releasing and receiving means for said alternate-material ball and a second housing for said releasing means for said one gumball;

(b) said first and second housings being located adjacent one another.

7. A kinetic activity gumball-dispensing device as in claim 1, wherein:

(a) said gumball-dispensing device further comprises a user-operable actuating mechanism;

(b) said releasing and receiving means for said alternate-material ball are adapted to hold a plurality of alternate-material balls such that when one alternate-material ball is received by said receiving means, a second alternate-material ball is ready to be released by said releasing means;

(c) whereby upon actuation of said user-operable actuating mechanism, an alternate-material ball can be immediately released along said first route.

8. A kinetic activity gumball-dispensing device as in claim 5, wherein said one gumball is visible at least along a portion of said second route.

9. A kinetic activity gumball-dispensing device as in claim 2, wherein said series of kinetic mechanisms includes an inclined pendular staircase, comprising:

(a) front and back sidewalls;

(b) a plurality of pendular steps aligned in spaced-apart, parallel relation between said front and back sidewalls;

(c) said sidewalls and said pendular steps forming a channel to guide said alternate-material ball down said inclined pendular staircase;

(d) each pendular step having:

(i) an axle rotatably supported between said front and back sidewalls;

(ii) a ball-contacting portion; and (iii) a counterweight;

(e) each pendular step having a rest position wherein an end of said ball-contacting portion is spaced from an adjacent lower pendular step a first distance, and having a rotated position wherein said end of said ball-contacting portion is spaced from said adjacent lower pendular step a second distance, less than said first distance, forming a rolling surface extending at least partially between said pendular step and said adjacent lower pendular step; and (f) each pendular step being pivotal from said rest position to said rotated position by said alternate-material ball, and said counterweight being adapted to return said pendular step to said rest position after the passage of said alternate-material ball;

(g) whereby said alternate-material ball can travel down said inclined pendular staircase by sequentially contacting and rotating said pendular steps thereby providing a visually interesting kinetic path for said alternate-material ball.

10. A kinetic activity gumball-dispensing device as in claim 9, wherein said front sidewall is at least partially transparent to provide visual access to the movement of said alternate-material ball and said pendular steps as said alternate-material ball travels down said pendular staircase.

11. A kinetic activity gumball-dispensing device as in claim 2, wherein said series of kinetic mechanisms includes a turntable mechanism, comprising:

(a) a pivot;

(b) holding means spaced radially outward from said pivot, said holding means being adapted to support said alternate-material ball during rotation of said turntable;

(c) a discharge means adapted to remove said alternate-material ball from said holding means;

(d) said turntable having a first position wherein said holding means is aligned to accept said alternate-material ball, and having a second position wherein said discharge means is aligned to remove said alternate-material ball from said turntable; and (e) means to rotate said turntable mechanism between said first and second positions.

12. A kinetic activity gumball-dispensing device as in claim 11, wherein said holding means comprises an open-ended coil aligned to support said alternate-material ball on said open-end thereof, said coil having a diameter of approximately ⅞ths of a diameter of said alternate-material ball such that said alternate-material ball projects into said coil when supported thereon.

13. A kinetic activity gumball-dispensing device as in claim 12, wherein said discharge means comprises a dump rod fixedly secured to said gumball-dispensing device, said rod extending over said turntable and being aligned to contact said alternate-material ball when said turntable rotates past said second position.

14. A kinetic activity gumball-dispensing device as in claim 13, further comprising a control means to actuate said rotation means a predetermined amount of time after said alternate-material ball begins said first route to rotate said turntable from said first position through said second position after said alternate-material ball has been received in said holding means, and said control means stopping said rotation means when said turntable returns to said first position.

15. A kinetic activity gumball-dispensing device as in claim 14, wherein said control means comprises a means to sense the time at which said alternate-material ball begins said first route.

16. A kinetic activity gumball dispensing device as in claim 2, wherein said series of kinetic mechanisms includes an elevator, comprising:

(a) vertical guide means;

(b) support means movably mounted on said guide means;

(c) a carrier pivotally mounted to said support means; said carrier having a recess adapted to hold said alternate-material ball;

(d) said recess having a first end with a first width less than a diameter of said alternate-material ball and having a wide portion with a second width greater than said first width, such that when said carrier is in a horizontal position and said alternate-material ball is introduced to said first end of said recess, said alternate-material ball will roll toward said wide portion;

(e) said pivotal connection between said carrier and said support means being located intermediate said first end of said recess and a center of gravity of said carrier such that said carrier tends to rotate about said pivotal connection with said first end of said recess moving upward;

(f) means to limit the rotation of said carrier, said rotation limiting means being connected to said carrier and contacting said support means when said carrier has rotated into a limit position;

(g) stop means extending upwardly from said carrier, said stop means being located opposite said pivotal connection with respect to said center of gravity and being adapted to support said alternate-material ball when said carrier is rotated into said limit position;

(h) lifting means connected to said support means; and (i) discharge means adapted to rotate said carrier such that said first end of said recess moves downwardly to allow said alternate-material ball to roll off of said carrier, said discharge means rotating said carrier when said elevator reaches a predetermined height.

17. A kinetic activity gumball-dispensing device as in claim 16, wherein:

(a) said carrier further comprises a support plate and an elevator roost connected to said support plate, said elevator roost and said support plate forming said recess and said elevator roost having opposed ends forming said first end of said recess;

(b) said support plate extending below and beyond said opposed ends of said elevator roost and forming a lip to receive said alternate-material ball;

(c) said opposed ends of said elevator roost being spaced a distance less than a diameter of said alternate-material ball and said wide portion of said recess having a width sufficient to allow said alternate-material ball to contact said support plate when said alternate-material ball has rolled into said carrier; and (d) said discharge means comprises a rod positioned to contact said lip when said elevator reaches said predetermined height.

18. A kinetic activity gumball-dispensing device as in claim 17, wherein (a) said support means comprises a yoke surrounding said carrier; and (c) said yoke is slidably connected to said vertical guide means.

19. A kinetic activity gumball-dispensing device as in claim 16, wherein said lifting means comprises a limit switch sensor having a plasticly adjustable support to allow for adjustment of the position of said limit switch.

20. A kinetic activity gumball-dispensing device as in claim 19, further comprising a control means for actuating said lifting means, said control means actuating said lifting means upon receiving a signal associated with another kinetic mechanism.

21. A kinetic activity gumball-dispensing device as in claim 2, wherein said series of kinetic mechanisms includes a swivelling bucket mechanism, comprising:

(a) a crank arm pivotally mounted to a support structure;

(b) a bucket means pivotally connected to said crank arm, said bucket means being adapted to hold said alternate-material ball through at least a partial rotation of said crank arm;

(c) discharge means adapted to rotate said bucket means during rotation of said crank arm to remove said alternate-material ball therefrom; and (d) means to rotate said crank arm.

22. A kinetic activity gumball-dispensing device as in claim 21, further comprising a trampoline means aligned to intercept said alternate-material ball discharged from said bucket means.

23. A kinetic activity gumball-dispensing device as in claim 22, wherein said trampoline means further comprises a frame and a support, said frame being adjustably mountable to said support structure such that the position of said frame can be adjusted to allow said trampoline means to properly intercept said alternate-material ball.

24. A kinetic activity gumball-dispensing device as in claim 22, further comprising a bottom panel and a kinetic energy-absorbing cushion attached to said bottom panel, said cushion being aligned to catch said alternate-material ball after said alternate-material ball bounces off said trampoline means.

25. A kinetic activity gumball-dispensing device as in claim 2, further comprising an inclined panel located below said kinetic mechanisms, said inclined panel being adapted to direct said alternate-material ball to a ball-returning mechanism.

26. A kinetic activity gumball-dispensing device as in claim 2, further comprising a control means operable to actuate said series of kinetic mechanisms, said control means including means to sense the release of said alternate-material ball along said first route.

27. A kinetic activity gumball-dispensing device having an inclined pendular staircase, said pendular staircase comprising:

(a) front and back sidewalls, said front sidewalls being at least partially transparent;

(b) a plurality of pendular steps aligned in spaced-apart, parallel relation between said front and back sidewalls;

(c) said sidewalls and said pendular steps forming a channel to guide a ball down said inclined pendular staircase;

(d) each pendular step having:

(i) an axle rotatably supported between said front and back sidewalls;

(ii) a ball-contacting portion; and (iii) a counterweight;

(e) each pendular step having a rest position wherein an end of said ball-contacting portion is spaced from an adjacent lower pendular step a first distance, and having a rotated position wherein said end of said ball-contacting portion is spaced from said adjacent lower pendular step a second distance, less than said first distance, forming a rolling surface extending at least partially between said pendular step and said adjacent lower pendular step;

(f) each pendular step being pivotal from said rest position to said rotated position by said ball, and said counterweight being adapted to return said pendular step to said rest position after the passage of said ball;

(g) whereby said ball can travel down said inclined pendular staircase by sequentially contacting and rotating said pendular steps thereby providing a visually interesting kinetic path for said ball.

28. A kinetic activity gumball-dispensing device having a turn-table comprising:

(a) a pivot;

(b) holding means spaced radially outward from said pivot, said holding means being adapted to support a ball during rotation of said turntable;

(c) a discharge means adapted to remove said ball from said holding means;

(d) said turntable having a first position wherein said holding means is aligned to accept said ball, and having a second position wherein said discharge means is aligned to remove said ball from said turntable;

(e) means to rotate said turntable mechanism between said first and second positions;

(f) said holding means being an open-ended coil aligned to support said ball on said open-end thereof, said coil having a diameter of approximately ⅞ths of a diameter of said ball such that said ball projects into said coil when supported thereon;

(g) said discharge means being a dump rod fixedly secured to said gumball-dispensing device, said rod extending over said turntable and being aligned to contact said ball when said turntable rotates past said second position; and (h) a control means to actuate said rotation means after said ball has been received in said holding means, and said control means stopping said rotation means when said turntable returns to said first position.

29. A kinetic activity gumball-dispensing device having a tilt-releasing lift elevator, comprising:

(a) vertical guide means;

(b) support means movably mounted on said guide means;

(c) a carrier pivotally mounted to said support means, said carrier having a recess adapted to hold a ball;

(d) said recess having a first end with a first width less than a diameter of said ball and having a wide portion with a second width greater than said first width, such that when said carrier is in a horizontal position and said ball is introduced to said first end of said recess, said ball will roll toward said wide portion;

(e) said pivotal connection between said carrier and said support means being located intermediate said first end of said recess and a center of gravity of said carrier such that said carrier tends to rotate about said pivotal connection with said first end of said recess moving upward;

(f) means to limit the rotation of said carrier, said rotation limiting means being connected to said carrier and contacting said support means when said carrier has rotated into a limit position;

(g) stop means extending upwardly from said carrier, said stop means being located opposite said pivotal connection with respect to said center of gravity and being adapted to support said ball when said carrier is rotated into said limit position;

(h) lifting means connected to said support means;

(i) discharge means adapted to rotate said carrier such that said first end of said recess moves downwardly to allow said ball to roll off of said carrier, said discharge means rotating said carrier when said elevator reaches a predetermined height;

(j) said carrier including a support plate and an elevator roost connected to said support plate, said elevator roost and said support plate forming said recess and said elevator roost having opposed ends forming said first end of said recess;

(k) said support plate extending below and beyond said opposed ends of said elevator roost and forming a lip to receive said ball;

(l) said opposed ends of said elevator roost being spaced a distance less than a diameter of said ball and said wide portion of said recess having a width sufficient to allow said ball to contact said support plate when said ball has rolled into said carrier;

(m) said discharge means including a rod positioned to contact said lip when said elevator reaches said predetermined height;

(n) said support means including a yoke surrounding said carrier, said yoke being slidably connected to said vertical guide means;

(o) said lifting means including a limit switch sensor having a plasticly adjustable support to allow for adjustment of the position of said limit switch; and (p) control means for actuating said lifting means.

30. A kinetic activity gumball-dispensing device having a swivelling bucket mechanism comprising:

(a) a crank arm pivotally mounted to a support structure;

(b) a bucket means pivotally connected to said crank arm, said bucket means being adapted to hold a ball through at least a partial rotation of said crank arm;

(c) discharge means adapted to rotate said bucket means during rotation of said crank arm to remove said ball therefrom; and (d) means to rotate said rank arm;

(e) trampoline means aligned to intercept said ball discharged from said bucket means, said trampoline means further comprises a frame adjustably mountable to a panel such that the position of said frame can be adjusted to allow said trampoline means to properly intercept said ball; and (f) deceleration means located above said panel for absorbing the kinetic energy of said ball after bouncing off said trampoline means.

* * * * *